US008375829B2

(12) United States Patent
Lin

(10) Patent No.: US 8,375,829 B2
(45) Date of Patent: Feb. 19, 2013

(54) WRENCH FOR PROVIDING TWO OPERATIVE MODES

(75) Inventor: Da-Sen Lin, Taichung (TW)

(73) Assignee: Pard Hardware Industrial Co., Ltd., Taichung (TW)

( * ) Notice: Subject to any disclaimer, the term of this patent is extended or adjusted under 35 U.S.C. 154(b) by 711 days.

(21) Appl. No.: 12/555,475

(22) Filed: Sep. 8, 2009

(65) Prior Publication Data

US 2011/0056335 A1 Mar. 10, 2011

(51) Int. Cl.
*B25B 13/00* (2006.01)

(52) U.S. Cl. .... 81/58.1; 81/177.7; 81/177.8; 81/177.75; 81/177.85; 81/177.9

(58) Field of Classification Search ..... 81/58.1, 81/177.8, 177.7, 177.75, 177.85, 177.9
See application file for complete search history.

(56) References Cited

U.S. PATENT DOCUMENTS 7,104,165 B2 * 9/2006 Chu ..... 81/177.8
7,267,033 B1 * 9/2007 Lai ..... 81/57.29

* cited by examiner

*Primary Examiner* — Joseph J Hail
*Assistant Examiner* — Shantese McDonald

(57) ABSTRACT

A wrench includes a handle, a yoke, a shaft, a head, a mandrel, a first transmitting unit and a second transmitting unit. The shaft includes a first section securely connected to the handle and a second section rotationally inserted in the yoke. The head is pivotally connected to the yoke. The mandrel is inserted through the head. The first transmitting unit can be used to transmit a small torque to the mandrel from the handle spun relative to the yoke. The second transmitting unit can be used together with the first transmitting unit to transmit a large torque to the mandrel from the handle pivoted together with the yoke.

9 Claims, 9 Drawing Sheets

WRENCH FOR PROVIDING TWO OPERATIVE MODES

BACKGROUND OF INVENTION

1. Field of Invention

The present invention relates to a wrench for providing two operative modes for driving a fastener.

2. Related Prior Art

A selective one-way wrench includes a handle, a head formed on the handle, a mandrel, a transmitting unit and a direction-selecting unit operable for selecting one of two directions in which the head drives the mandrel through the transmitting unit.

The wrench can be used together with a socket to slack or tighten a fastener. The mandrel is inserted in an end of the socket while the fastener is inserted in an opposite end of the socket.

To slack the fastener, the wrench is used to exert a large torque on the fastener initially. Once the fastener is slacked, it would be faster to drive the fastener with a bare hand than with the wrench.

To tighten the fastener, it would be faster to drive the fastener with a bare hand than with the wrench initially. At a final stage, the wrench is used to exert a large torque on the fastener.

There are wrenches each including a handle, a head formed on the handle, a mandrel, a transmitting unit, a direction-selecting unit operable for selecting one of two directions in which the head drives the mandrel through the transmitting unit and a shaft connected to the transmitting unit. At an initial stage of a slacking operation or a final stage of a tightening operation, the handle is operated to drive the mandrel through the transmitting unit. For the rest of the slacking or tightening operation, the shaft is operated to drive the mandrel through the transmitting unit. Such wrenches can be found in EP 0486710, U.S. Pat. No. 454,567, U.S. Pat. No. 5,105,688, U.S. Pat. No. 6,070,499, WO 8803999, WO 9207692 and Taiwanese Patent Publication No. 494828 for example. In each of these wrenches, the head is secured to the handle and this could be inconvenient when it is used in limited space.

The present invention is therefore intended to obviate or at least alleviate the problems encountered in prior art.

SUMMARY OF INVENTION

It is the primary objective of the present invention to provide a two-mode wrench with a head pivotally connected to a handle.

To achieve the foregoing objective, the wrench includes a handle, a yoke, a shaft, a head, a mandrel, a first transmitting unit and a second transmitting unit. The shaft includes a first section securely connected to the handle and a second section rotationally inserted in the yoke. The head is pivotally connected to the yoke. The mandrel is inserted through the head. The first transmitting unit can be used to transmit a small torque to the mandrel from the handle spun relative to the yoke. The second transmitting unit can be used together with the first transmitting unit to transmit a large torque to the mandrel from the handle pivoted together with the yoke.

Other objectives, advantages and features of the present invention will be apparent from the following description referring to the drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
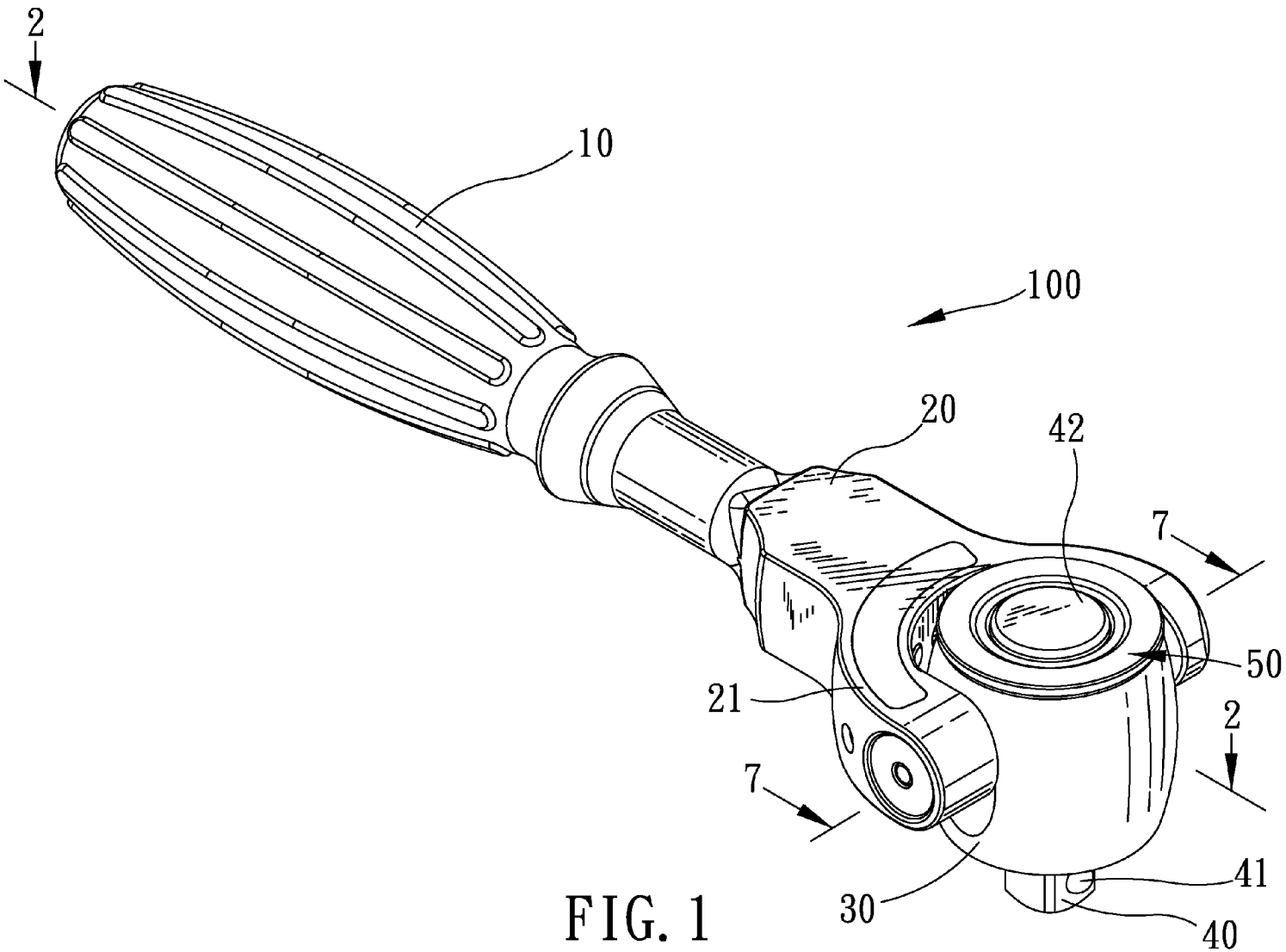
FIG. 1 is a perspective view of a two-mode wrench according to the preferred embodiment of the present invention.

Referring to FIGS. 1 through 7, a two-mode wrench 100 includes a handle 10, a yoke 20, a head 30 pivotally connected to the yoke 20, a mandrel 40, a direction-selecting unit 50, a first transmitting unit, a second transmitting unit and a clutch 70 according to the preferred embodiment of the present invention. The wrench 100 is used with a socket to drive a fastener such as a nut and a screw. The mandrel 40 is inserted in a first cavity defined in the socket while the fastener is inserted in a second cavity defined in the socket. The direction-selecting unit 50 is operable to choose from two directions in which the wrench 100 rotates the fastener. At an initial stage of a slacking operation or a final stage of a tightening operation where a large torque is needed, the handle 10 is operated to drive the mandrel 40 via the first and second transmitting units. For the rest of the slacking or tightening operation, the handle 10 is operated to drive the mandrel 40 via the first transmitting unit only.

Figure 2:
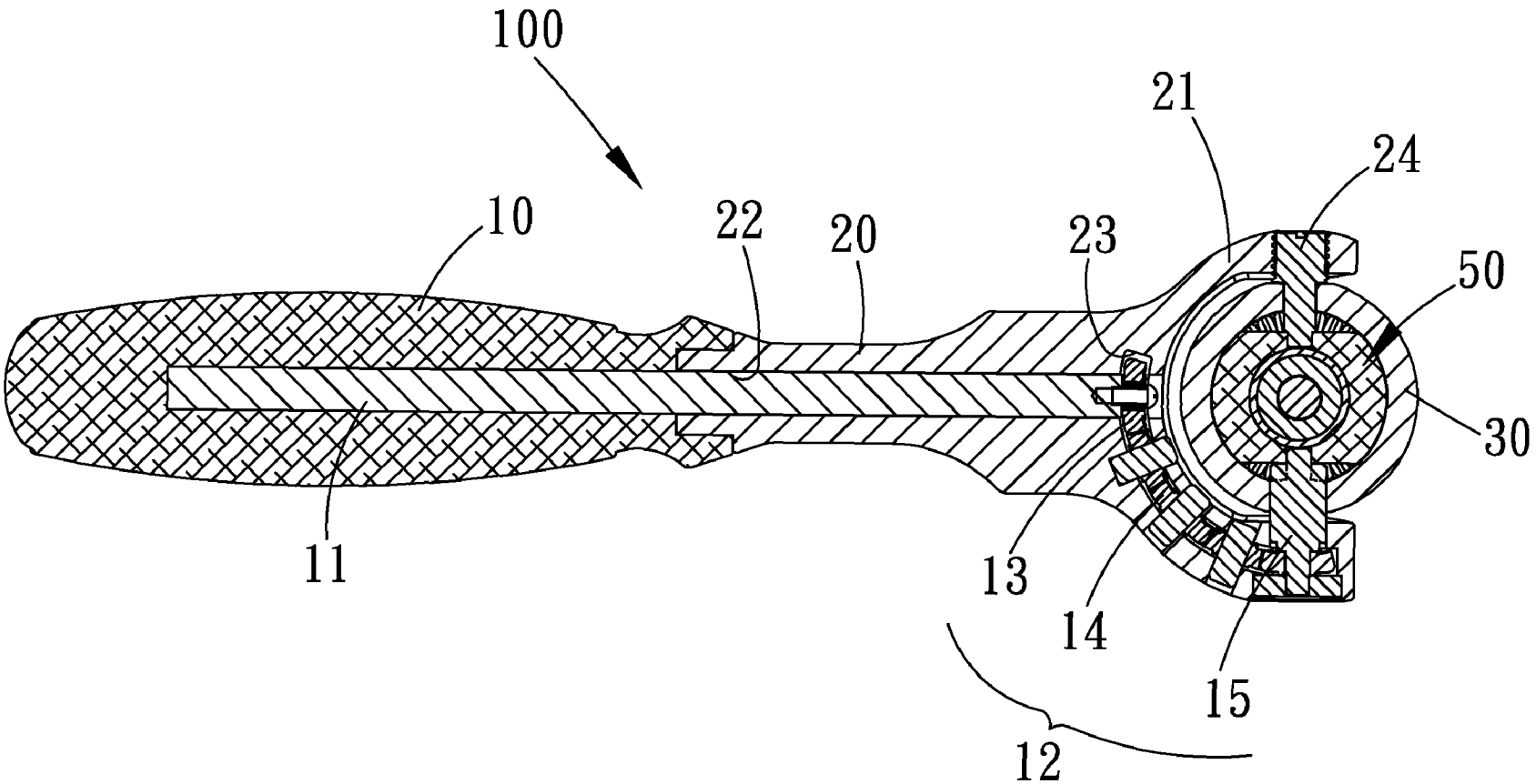
FIG. 2 is a cross-sectional view of the wrench shown in FIG. 1.
Figure 3:
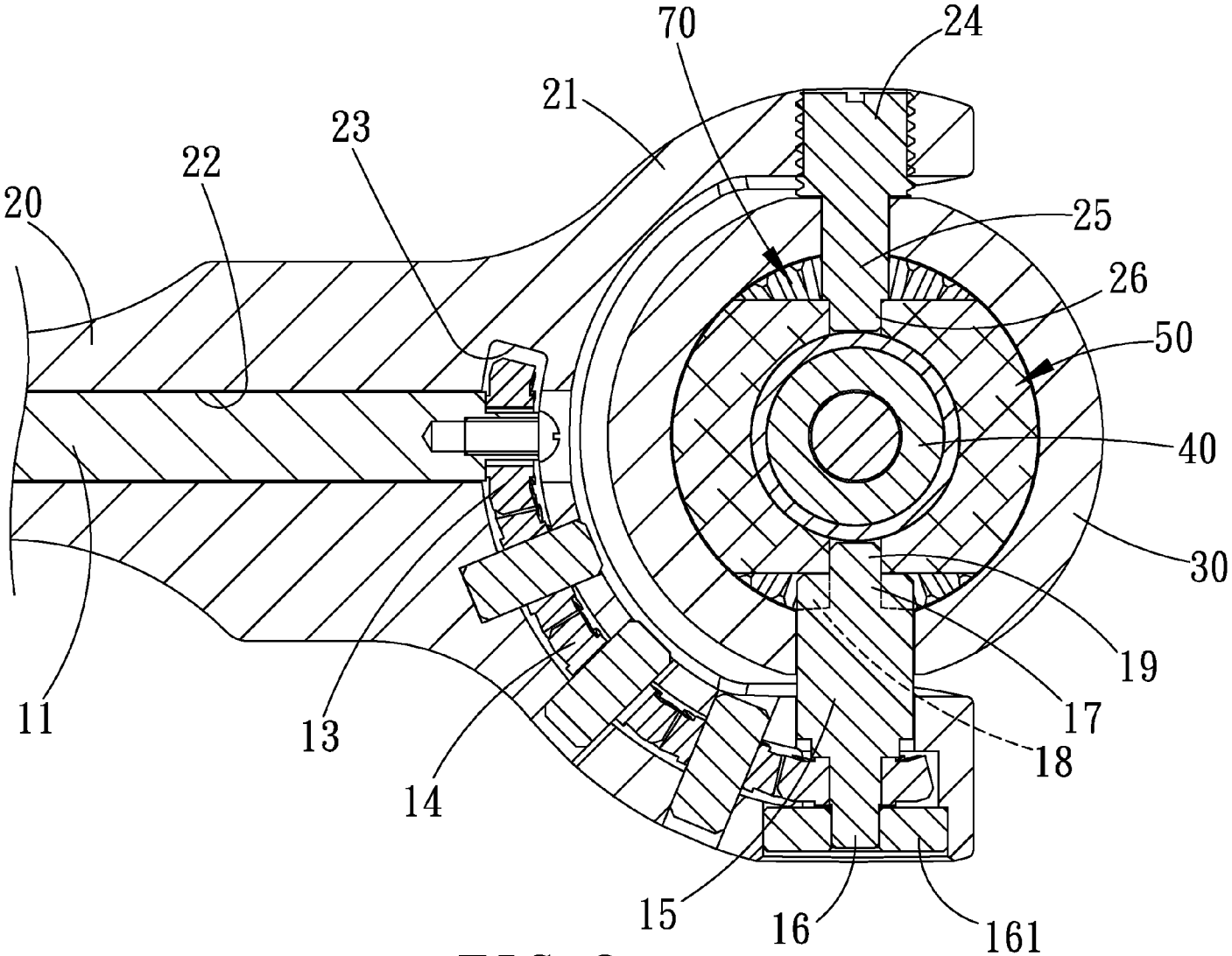
FIG. 3 is an enlarged, partial view of the wrench shown in FIG. 2.
Figure 4:
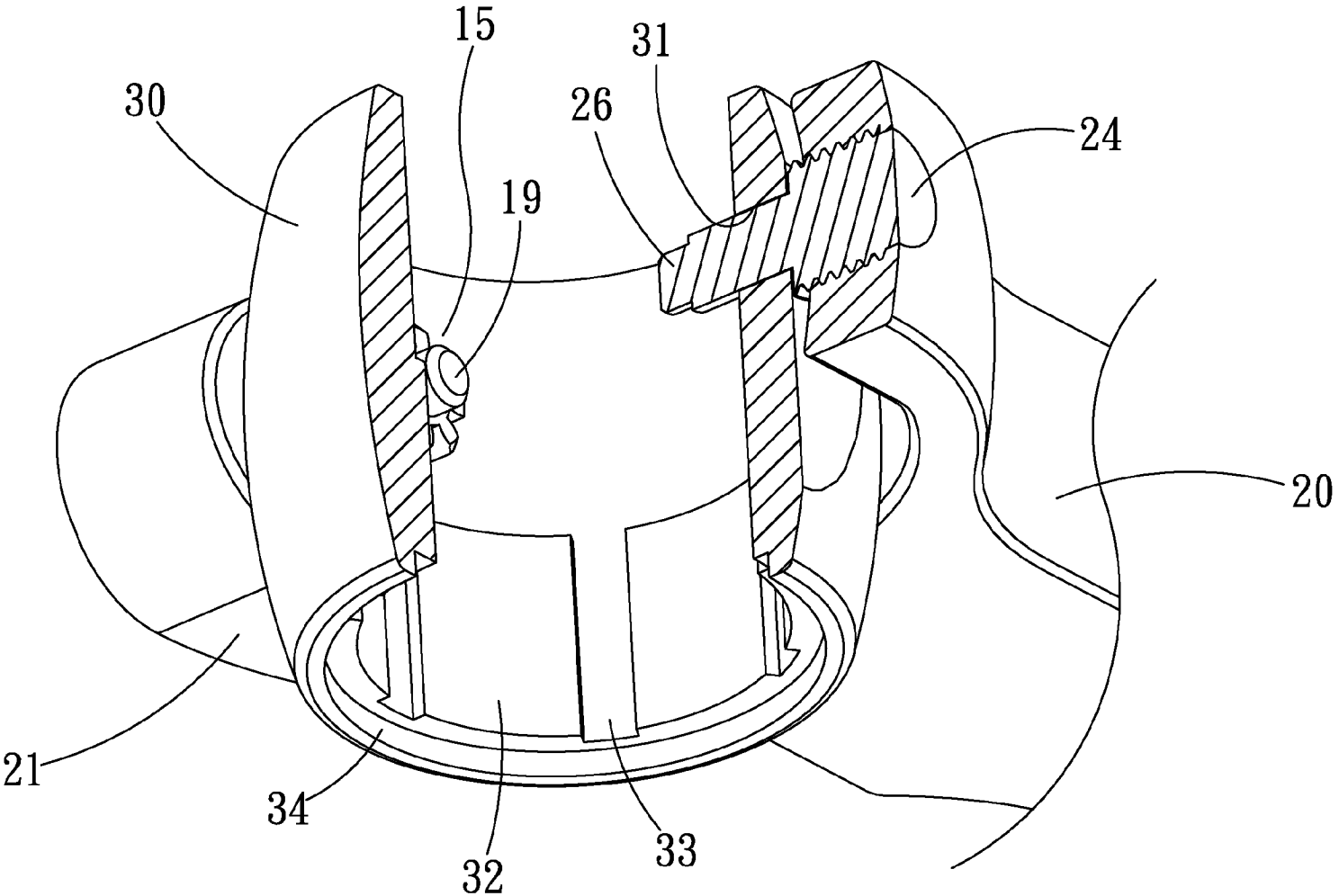
FIG. 4 is an enlarged, partial, cutaway view of the wrench shown in FIG. 1.

Referring to FIGS. 2 through 4, the yoke 20 includes two branches 21 extended from two opposite sides thereof, a tunnel 22 defined therein and a chamber 23 defined in one of the branches 21. The chamber 23 is in communication with the tunnel 22. The head 30 is pivotally connected to the branches 21 with an axle 15 and a pin 24. The clutch 70 is located in the head 30 and will be described in detail later.

The head 30 includes a space 32 centrally defined therein. There are grooves 33 longitudinally defined in the wall of the space 32 so that the grooves 33 are in communication with the space 32. A groove 34 is annularly defined in the wall of the space 32 so that the groove 34 is in communication with the space 32 and the grooves 33. Two apertures 31 are transversely defined in the head 30 so that the apertures 31 are in communication with the space 32.

The axle 15 includes a first reduced end 16, a second reduced end 19 and a middle section 17 formed between the first reduced end 16 and the second reduced end 19. The first reduced end 16 of the axle 15 is inserted through the chamber 23 and connected to a plug 161. The middle section 17 of the axle 15 is inserted through one of the apertures 31 so that the second reduced end 19 of the axle 15 is located in the space 32. The middle section 17 of the axle 15 is formed with teeth 18. The teeth 18 are operatively connected to the clutch 70.

The pin 24 includes an enlarged end, a reduced end 26 and a middle section 25 between the enlarged and reduced ends. The enlarged end of the pin 24 is a threaded portion engaged with a screw hole defined in the related branch 21 of the yoke 20. The middle section 25 of the pin 24 is inserted through the other aperture 31 so that the reduced end 26 of the pin 24 is located in the space 32.

Figure 5:
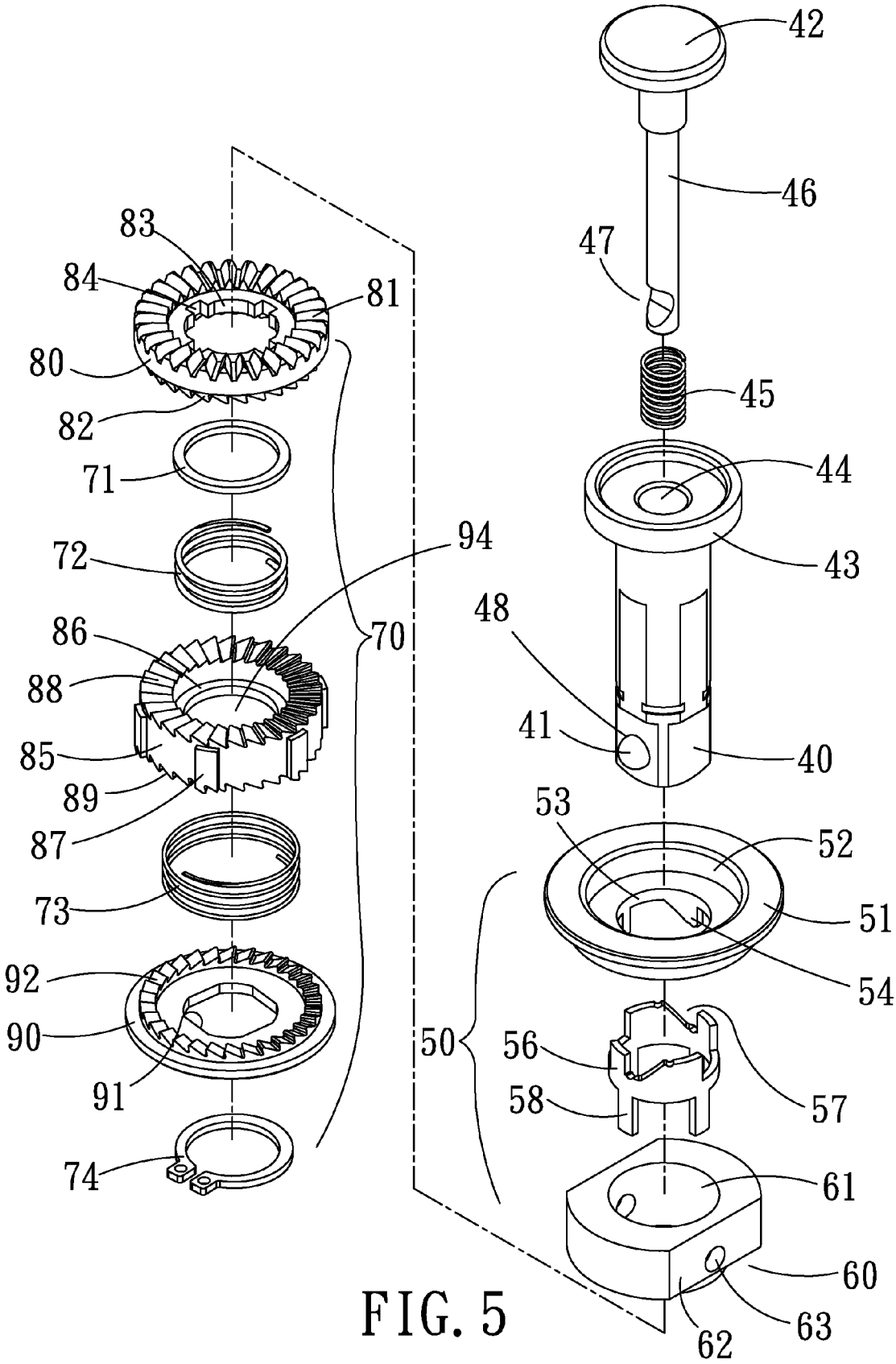
FIG. 5 is a partial, exploded view of the wrench shown in FIG. 1.
Figure 6:
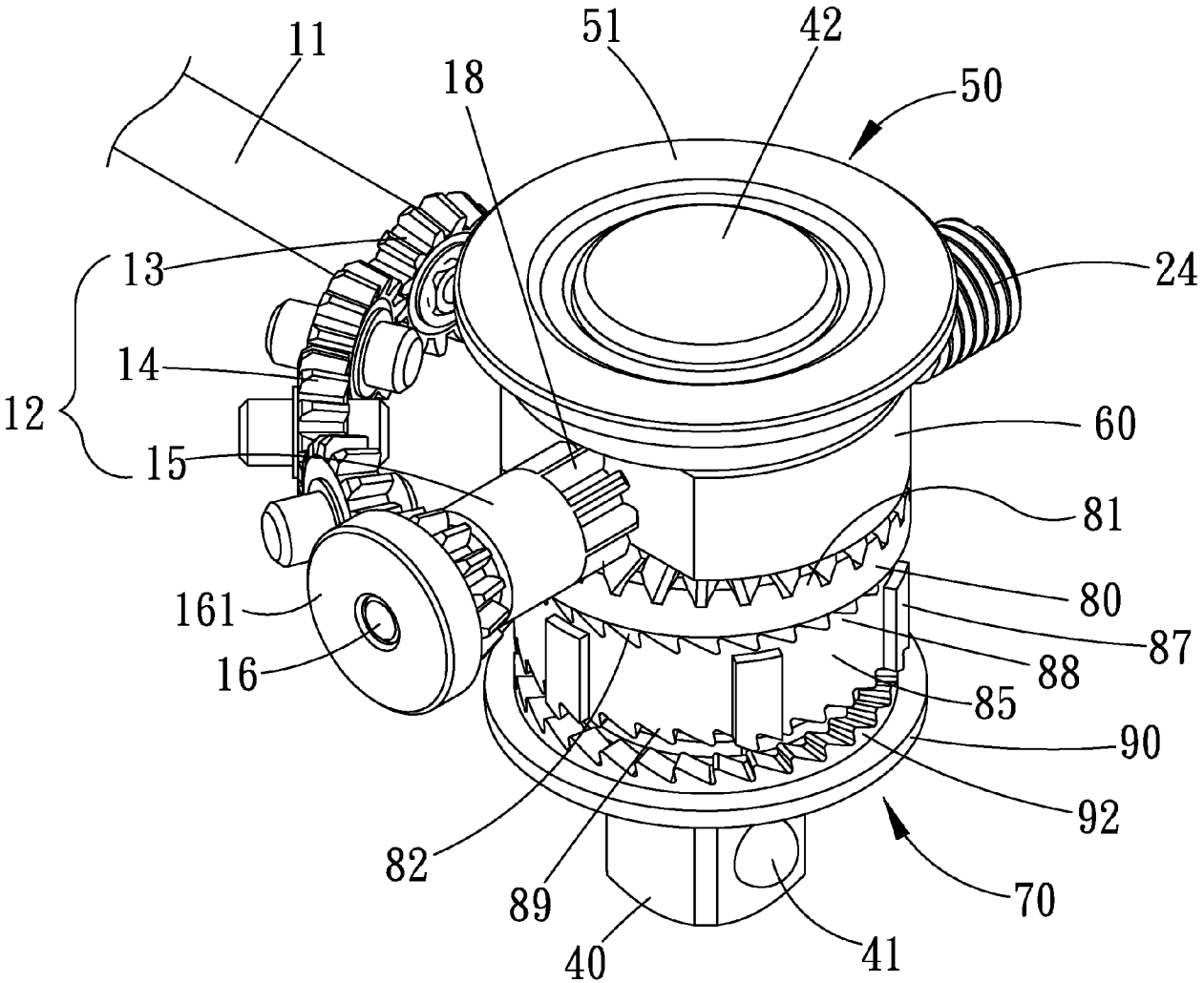
FIG. 6 is a perspective view of the wrench shown in FIG. 5.
Figure 7:
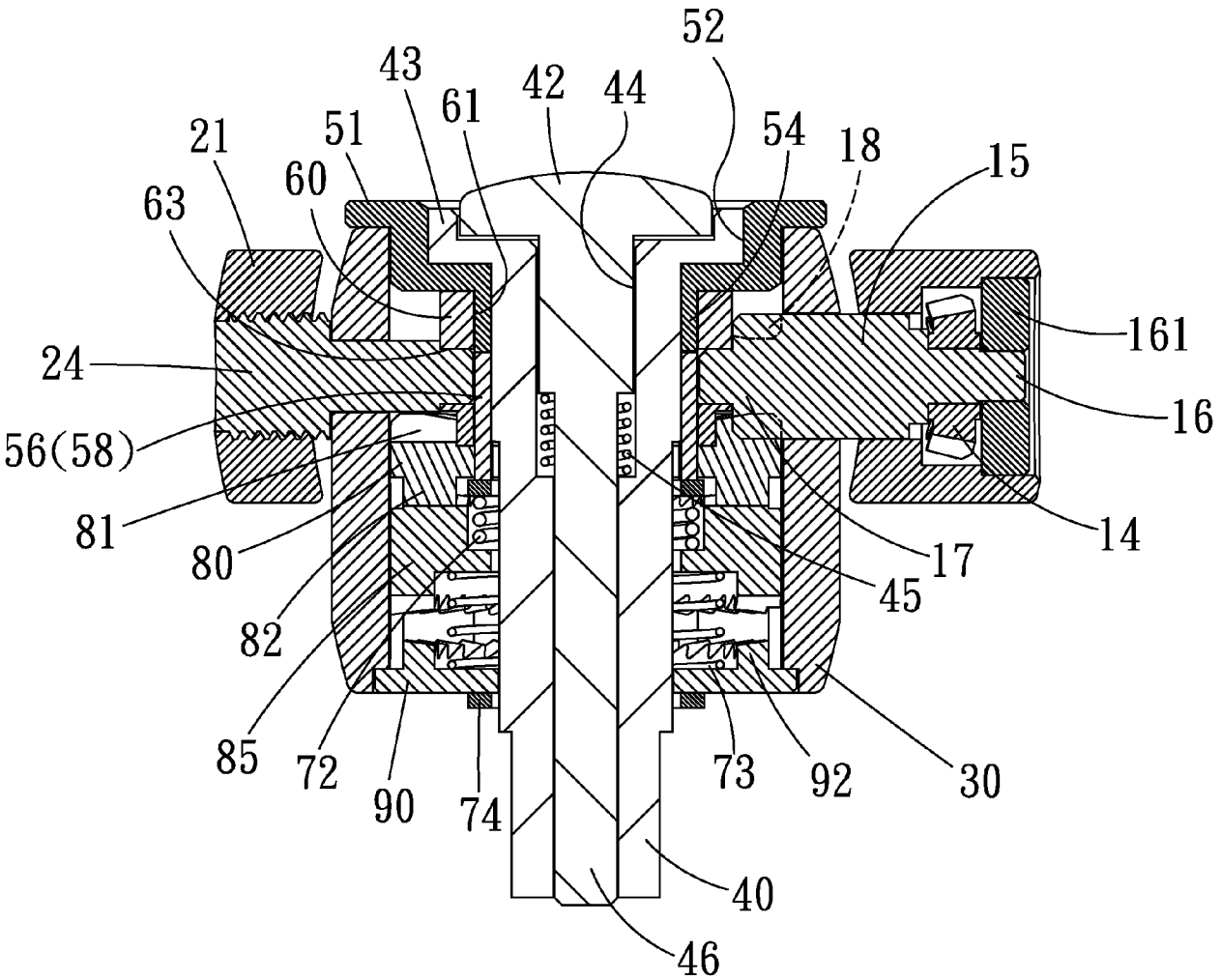
FIG. 7 is another enlarged, cross-sectional view of the wrench shown in FIG. 1.

Referring to FIGS. 5 through 7, the periphery of the mandrel 40 is non-circular. The mandrel 40 includes a tunnel 44 axially defined therein and an aperture 48 transversely defined therein so that they are in communication with each other. The mandrel 40 includes a frame 43 formed thereon.

A ball 41 includes a portion located in the tunnel 44 and another portion exposed to the exterior of the mandrel 40 through the aperture 48. The tunnel 44 includes a narrow lower section, a wide upper section and an annular shoulder between the lower and upper sections. A spring 45 is located in the upper section of the tunnel 44. A button 42 is formed on a rod 46. A recess 47 is defined in the rod 46. The rod 46 is inserted in the tunnel 44 so that it is in contact with the ball 41. The rod 46 is inserted through the spring 45. The spring 45 is compressed between the button 42 and the annular shoulder.

When the button 42 is pushed, a first portion of the ball 41 can be located in the recess 47 so that an opposite second portion of the ball 41 can be located in the aperture 48. Thus, the mandrel 40 can be inserted in the first cavity defined in the socket. On being released, the button 42 is lifted with the spring 45. The first portion of the ball 41 is abutted against the rod 46, thus keeping the second portion of the ball 41 exposed to the exterior of the mandrel 40. The second portion of the ball 41 is abutted against an internal side of the socket, thus keeping the socket connected to the mandrel 40. Thus, the nut or screw can be driven with the mandrel 40 through the socket.

The direction-selecting unit 50 includes a knob 51, a pusher 56 and a ring 60. The knob 51 includes a cavity 52 defined in a side, an aperture 53 defined therein and wedges 54 formed on an opposite side. The pusher 56 includes wedges 57 formed on a side and legs 58 formed on an opposite side. The ring 60 includes an aperture 61 defined therein, two planar faces 62 formed thereon and two recesses 63 each defined in a related one of the planar faces 62.

One of the apertures 61 receives the second reduced end 19 of the axle 15 while the other aperture 61 receives the reduced end 26 of the pin 24. Thus, the ring 60 is connected to the yoke 20. The pusher 56 is inserted through the aperture 61 of the ring 60. The knob 51 is located on the pusher 56 so that the wedges 54 of the knob 51 are engaged with the wedges 57 of the pusher 56. Thus, the pusher 56 is moved with the knob 51 when the knob 51 is rotated relative to the pusher 56.

The first transmitting unit includes a shaft 11, a gear train 12 and toothed wheels 80 and 90. The shaft 11 includes a section securely inserted in the handle 10 and another section rotationally inserted in the tunnel 22 defined in the yoke 20. The gear train 12 is located in the chamber 23. The gear train 12 includes an active gear 13 and passive gears 14. The active gear 13 is securely connected to the shaft 11. A first one of the passive gears 14 is engaged with the active gear 13. A last one of the passive gears 14 is securely provided on the first reduced end 16 of the axle 15. Thus, when the handle 10 is rotated relative to the yoke 20, the shaft 11 rotates the axle 15 through the gear train 12.

The toothed wheel 80 includes teeth 81 formed on a side and ratchets 82 formed on an opposite side. The toothed wheel 80 includes an aperture 83 defined therein corresponding to the non-circular periphery of the mandrel 40 and four recesses 84 defined therein corresponding to the legs 58 of the pusher 56. The mandrel 40 is inserted through the aperture 83 so that the mandrel 40 and the toothed wheel 80 can only be rotated together. The legs 58 are inserted through the recesses 84. The teeth 81 of the toothed wheel 80 are engaged with the teeth 18 of the axle 15.

The toothed wheel 90 includes an aperture 91 defined therein corresponding to the non-circular periphery of the mandrel 40 and ratchets 92 formed on a side. The mandrel 40 is inserted through the aperture 91 so that the mandrel 40 and the toothed wheel 90 can only be rotated together.

The second transmitting unit includes a toothed wheel 85. The toothed wheel 85 includes ratchets 88 formed on a side, ratchets 89 formed on an opposite side, an aperture 94 defined therein, an annular flange 86 on the wall of the aperture 94 and blocks 87 formed on the periphery thereof. The mandrel 40 is inserted through the aperture 94. The blocks 87 are located in the grooves 33 so that the toothed wheel 85 can be moved but not rotated in the head 30. The ratchets 88 of the toothed wheel 85 can be engaged with the ratchets 82 of the toothed wheel 80. The ratchets 89 of the toothed wheel 85 can be engaged with the ratchets 92 of the toothed wheel 90.

The clutch 70 includes a ring 71, springs 72 and 73 and a C-clip 74. The ring 71 and the spring 72 are located against each other and between the toothed wheels 80 and 85. The spring 72 is located in the aperture of the second ring 85 and abutted against the annular flange 86. Thus, the spring 72 is compressed between the toothed wheels 80 and 85. The spring 73 is compressed between the toothed wheels 85 and 90. A C-clip 74 is located in the groove 34 for retaining the clutch 70 within the head 30.

Figure 8:
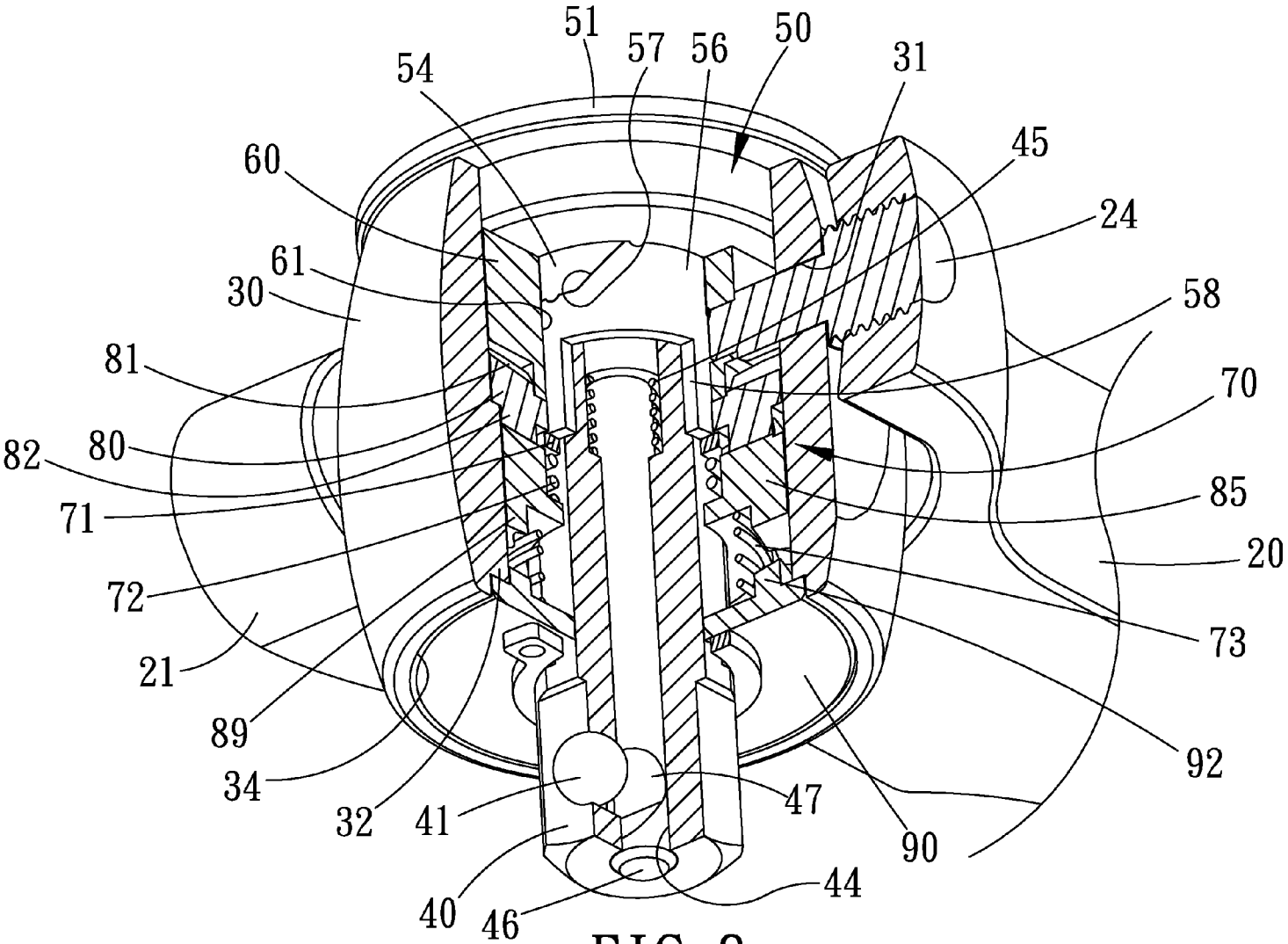
FIG. 8 is an enlarged, partial, cutaway view of the wrench shown in FIG. 1.

Referring to FIGS. 6 and 8, to provide a small torque for driving the fastener clockwise, the handle 10 is rotated relative to the yoke 20 so that the shaft 11 is rotated relative to the yoke 20. The shaft 11 rotates the toothed wheel 80 via the gear train 12. The toothed wheel 80 rotates the mandrel 40. The ratchets 82 of the toothed wheel 80 rattle on the ratchets 88 of the toothed wheel 85.

In any attempt to rotate the toothed wheel 80 counterclockwise relative to the toothed wheel 85, the ratchets 82 are locked with the ratchets 88. The toothed wheel 80 cannot rotate relative to the toothed wheel 85. Therefore, the toothed wheel 80 cannot rotate the mandrel 40.

To provide a large torque for tightening the fastener, the handle 10 and the yoke 20 are rotated together. The yoke 20 rotates the head 30. The head 30 rotates the toothed wheel 85. The toothed wheel 85 rotates the toothed wheel 80 because the ratchets 88 are engaged with the ratchets 82. The toothed wheel 80 rotates the mandrel 40.

Figure 9:
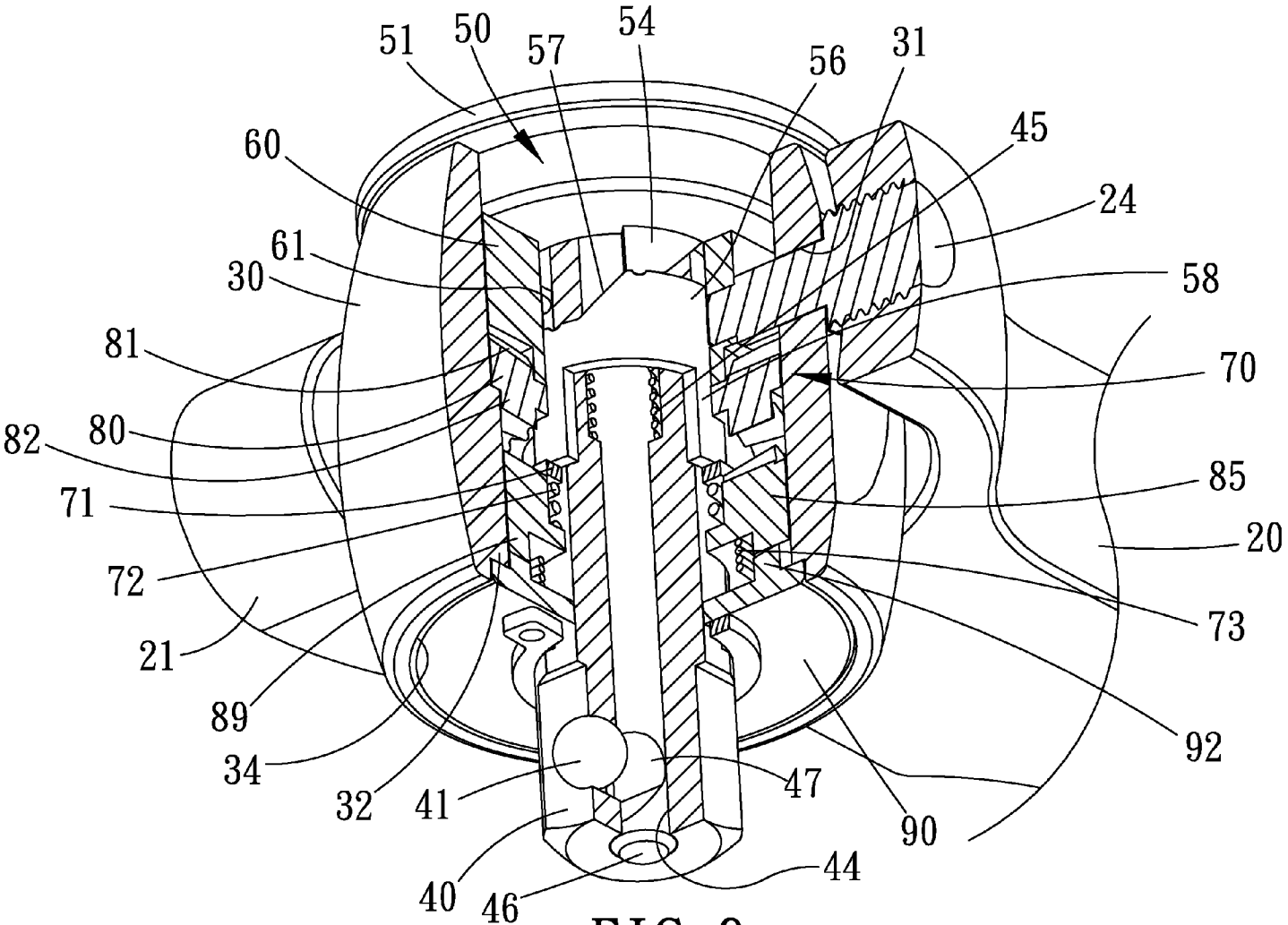
FIG. 9 is an enlarged, partial, cutaway view of the wrench in another position than shown in FIG. 8.

Referring to FIG. 9, to slack the fastener, the knob 51 is rotated relative to the pusher 56. The knob 51 moves the pusher 56 downwards due to the engagement of the wedges 57 of the former with the wedges 54 of the latter. The pusher 56 pushes down the toothed wheel 85 due to the contact of the legs 58 of the pusher 56 with the annular flange 86 of the toothed wheel 85. The ratchets 88 of the toothed wheel 85 are disengaged from the ratchets 82 of the toothed wheel 80 while the ratchets 89 of the toothed wheel 85 are engaged with the ratchets 92 of the toothed wheel 90.

To provide a large torque for slacking the fastener, the handle 10 and the yoke 20 are rotated together. The yoke 20 rotates the head 30. The head 30 rotates the toothed wheel 85. The toothed wheel 85 rotates the toothed wheel 90 for the engagement of the ratchets 89 with the ratchets 92. The toothed wheel 90 rotates the mandrel 40.

To provide a small torque for driving the fastener counterclockwise, the handle 10 is rotated relative to the yoke 20 so that the shaft 11 is rotated relative to the yoke 20. The shaft 11 rotates the toothed wheel 80 via the gear train 12. The toothed wheel 80 rotates the mandrel 40.

In any attempt to rotate the toothed wheel 85 clockwise, the ratchets 92 of the toothed wheel 90 are locked with the ratchets 89 of the toothed wheel 85. The toothed wheel 90 cannot rotate clockwise relative to the toothed wheel 85. Therefore, the toothed wheel 90 cannot rotate the mandrel 40.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A wrench comprising:

a handle;

a yoke;

a shaft comprising a first section securely connected to the handle and a second section rotationally inserted in the yoke;

a head pivotally connected to the yoke;

a in comprising a first end inserted in the yoke and a second end inserted in the head; and an axle comprising a first end inserted in the yoke and a second end inserted in the head;

a mandrel inserted through the head;

a first transmitting unit for transmitting a small torque to the mandrel from the handle spun relative to the yoke, wherein the first transmitting unit includes a toothed wheel securely provided around the mandrel and engaged with the axle; and a second transmitting unit in cooperation with the first transmitting unit to transmit a large torque to the mandrel from the handle pivoted together with the yoke, wherein the second transmitting unit includes a toothed wheel engaged with the toothed wheel of the first transmitting unit and non-rotationally connected to the head.

2. The wrench according to claim 1, wherein the first transmitting unit comprises:

a gear train comprising a first gear securely provided around the shaft and a last gear securely provided around the axle.

3. The wrench according to claim 1, wherein the head comprises grooves defined in an internal side, and the toothed wheel of the second transmitting unit comprises blocks located in the grooves of the head.

4. The wrench according to claim 1 comprising a direction-selecting unit operable to choose from two directions in which the wrench rotates the fastener.

5. The wrench according to claim 4, wherein the direction-selecting unit comprises a toothed wheel movable between a first position and a second position in the head and formed with a first group of ratchets on a side and a second group of ratchets on an opposite side, and the first transmitting unit comprises:

a first toothed wheel securely provided around the mandrel and formed with a group of ratchets for engagement with the first group of ratchets of the toothed wheel of the direction-selecting unit in the first position;

a second toothed wheel securely provided around the mandrel and formed with a group of ratchets for engagement with the second group of ratchets of the toothed wheel of the direction-selecting unit in the second position; and a gear train comprising a first gear securely provided around the shaft and a last gear securely provided around the axle.

6. The wrench according to claim 5, wherein the direction-selecting unit comprises:

a knob rotationally provided on the head and formed with wedges on a side; and a pusher movably but non-rotationally located in the head and formed with wedges engaged with the wedges of the knob and legs in contact with the toothed wheel of the direction-selecting unit.

7. The wrench according to claim 6, comprising a clutch in cooperation with the direction-selecting unit for smoothly moving the toothed wheel of the direction-selecting unit between the first and second positions.

8. The wrench according to claim 7, wherein the clutch comprises:

a first spring compressed between the first toothed wheel of the first transmitting unit and the toothed wheel of the direction-selecting unit; and a second spring compressed between the second toothed wheel of the first transmitting unit and the toothed wheel of the direction-selecting unit.

9. The wrench according to claim 6, wherein the second transmitting unit comprises:

grooves defined in an internal side of the head; and blocks formed on the toothed wheel of the direction-selecting unit and movably located in the grooves.

* * * * *